US005365818A

United States Patent [19]

Levy

[11] Patent Number: 5,365,818

[45] Date of Patent: Nov. 22, 1994

[54] SEPARATELY MOVING HYDRAULIC PRESS AND DIE

[75] Inventor: Roger Levy, Bloomfield Hills, Mich.

[73] Assignee: Tishken Products Co., Oak Park, Mich.

[21] Appl. No.: 6,377

[22] Filed: Jan. 19, 1993

Related U.S. Application Data

[63] Continuation-in-part of Ser. No. 974,141, Nov. 10, 1992, abandoned.

[51] Int. Cl.[5] ..... B26D 1/60

[52] U.S. Cl. ..... 83/308; 83/314; 83/320

[58] Field of Search ..... 83/294, 308, 309, 314, 83/318, 319, 320

[56] References Cited

U.S. PATENT DOCUMENTS

| | | | |
|---|---|---|---|
| 2,414,906 | 1/1947 | Seltzer | 83/308 |
| 3,322,011 | 5/1967 | Kocian | 83/314 X |
| 3,442,167 | 5/1969 | Ohmasu | 83/319 X |
| 3,656,385 | 4/1972 | Kimbrell | 83/294 X |
| 4,377,097 | 3/1983 | Calvano | 83/319 X |
| 4,394,829 | 7/1983 | Stoehr | 83/314 |
| 4,727,783 | 3/1988 | John, Jr. | 83/308 X |
| 4,785,698 | 11/1988 | Stork | 83/319 X |
| 5,195,412 | 3/1993 | Flemming et al. | 83/320 X |

FOREIGN PATENT DOCUMENTS

| | | | |
|---|---|---|---|
| 1073014 | 2/1984 | U.S.S.R. | 83/308 |

*Primary Examiner*—Rinaldi I. Rada
*Attorney, Agent, or Firm*—Dykema Gossett

[57] ABSTRACT

An improved hydraulic press has a hydraulic die that is pulled to move along a work path relative to the hydraulic press by a moving coil of material. After movement the hydraulic die engages the hydraulic press and the two begin to move together. With this arrangement, the moving material only need initially overcome the inertia of the hydraulic die. The moving hydraulic die has momentum when it engages the hydraulic press, and that momentum assists in overcoming the inertia of the relatively heavy hydraulic press. A relatively thin sheet material can thus be utilized to move both the die and hydraulic press.

3 Claims, 4 Drawing Sheets

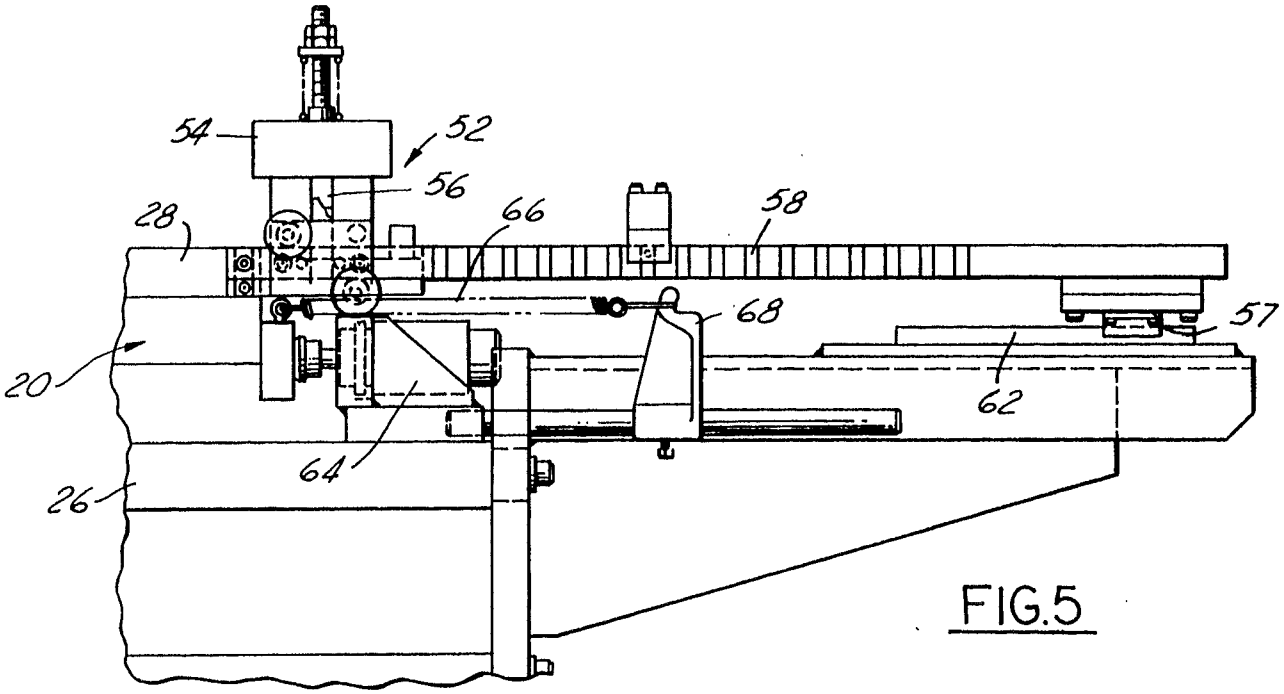
FIG.5
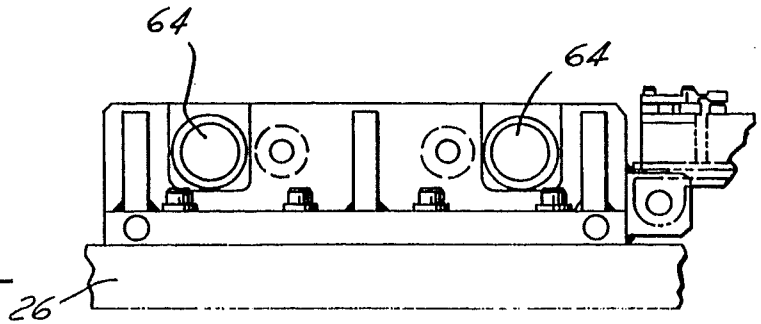
FIG.7
FIG.6
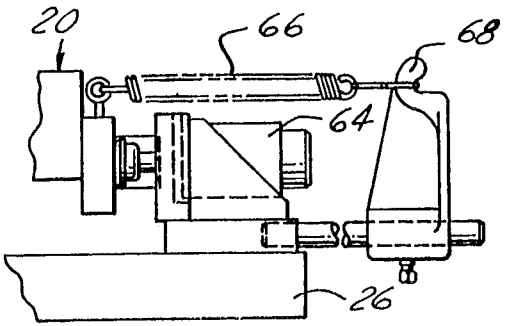

SEPARATELY MOVING HYDRAULIC PRESS AND DIE

This Application is a continuation-in-part of U.S. patent application Ser. No. 07/974,141 filed Nov. 10, 1992, now abandoned.

BACKGROUND OF THE INVENTION

In the prior art, hydraulic presses are used in roll-forming machines for forming apertures, or cutting workpieces. A hydraulic press includes a hydraulic drive which forces a first surface downwardly towards a die. Punches or dies are forced downwardly into the workpiece by the first surface. When such presses are used with a moving workpiece, a sliding surface on the die is engaged by the first surface. The sliding surface moves with a moving coil of material as it is forced downwardly, and slides relative to the first surface of the hydraulic drive as it moves. Since the hydraulic drive is applying a very large force to that sliding surface, the sliding surface contact creates an undue amount of friction and noise. Further, since movement of the workpiece alone pulls a sliding workpiece, it is sometimes difficult to achieve sufficient force to pull the sliding surface against the large downward force.

In the parent application of the present applications, an invention is disclosed wherein the hydraulic press moves with the die. In this way, the frictional contact between the downwardly moving surface and the die is eliminated. Instead, the die and the downward moving surface move together. This invention is an improvement over the prior art. However, since the moving coil of material must pull the press portions, it is sometimes difficult for a lower weight material to overcome the inertia of the relatively heavy press and die.

Thus, it is an object of this invention to disclose a hydraulic press and die which may be utilized with lighter materials.

SUMMARY OF THE INVENTION

In a disclosed embodiment of the present invention, a hydraulic press and die both move with a moving workpiece to punch apertures in the workpiece, or cut the workpiece. In a further feature of the present invention, the die and press move independently of each other along a work path. The die is initially engaged with the moving workpiece, and is moved by the moving workpiece. Once the die is moving, it engages the press. The workpiece then moves both the press and die. The press is actuated to apply the downward force after it begins moving with the die. Since the die is already moving when it contacts the press, the inertia which must be overcome to begin to move the press is relatively low. Moreover, the momentum from the moving die assists in overcoming the inertia of the press.

These and other objects of the present invention can be best understood from the following specification and drawings, of which the following is a brief description.

BRIEF DESCRIPTION OF THE DRAWINGS

FIG. 5 is a side view of one portion of the present invention.

FIG. 6 is a partial view of a further detail of the present invention.

FIG. 7 is an end view of the portion of the invention illustrated in FIG. 6.

DETAILED DESCRIPTION OF A PREFERRED EMBODIMENT

Figure 1:
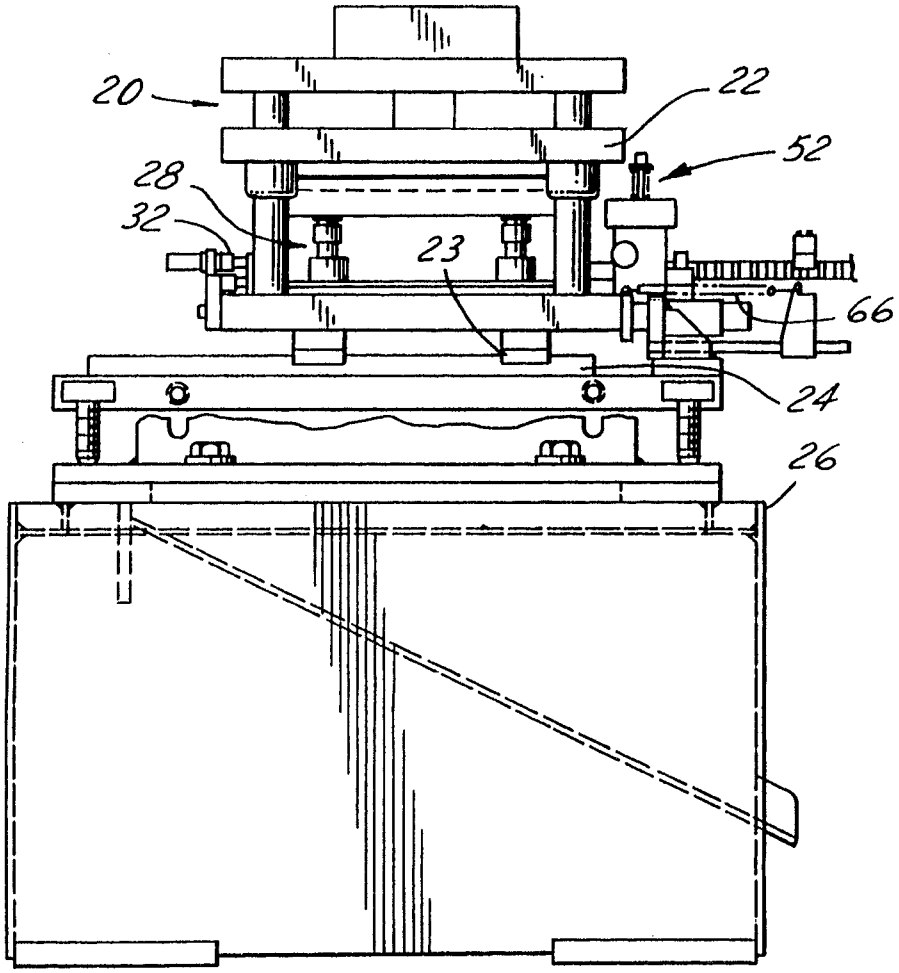
FIG. 1 is a largely schematic side view of a portion of this invention.

FIG. 1 illustrates a hydraulic press 20 including an upper press portion 22 and guides 23 which move along a rail 24. Rail 24 is associated with a base 26. Base 26 may be incorporated into a roll-forming machine.

Figure 2:
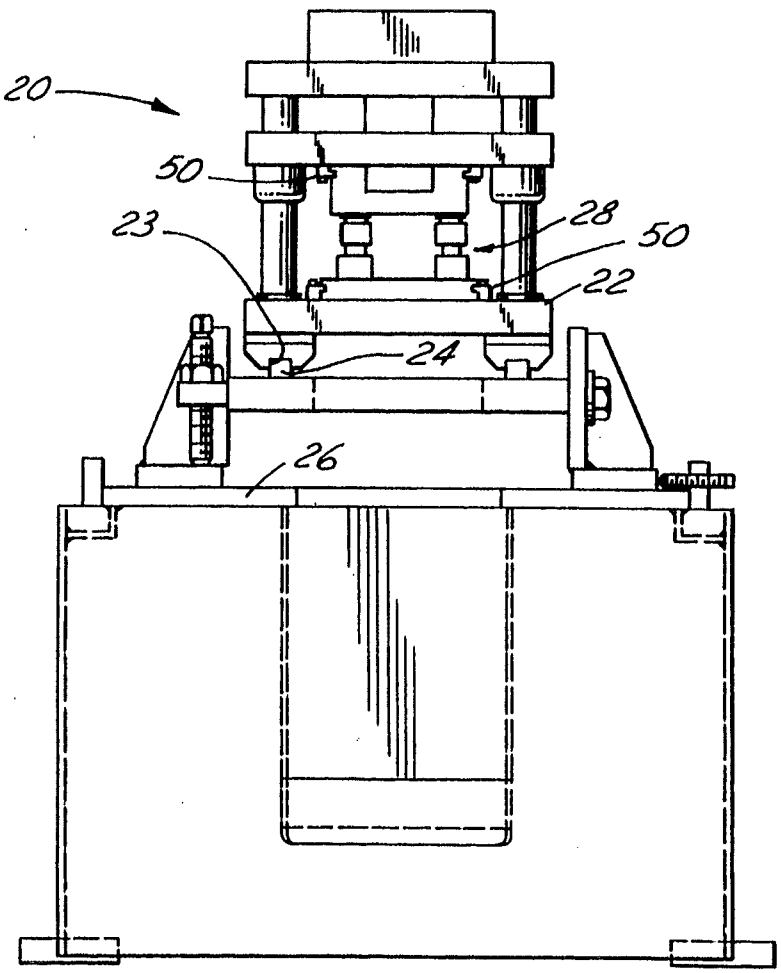
FIG. 2 is a largely schematic end view of an embodiment of this invention.

As shown in FIG. 2, a die 28 is mounted within press 20. As will be disclosed below, die 28 is mounted on rails for movement relative to press 20.

Figure 3:
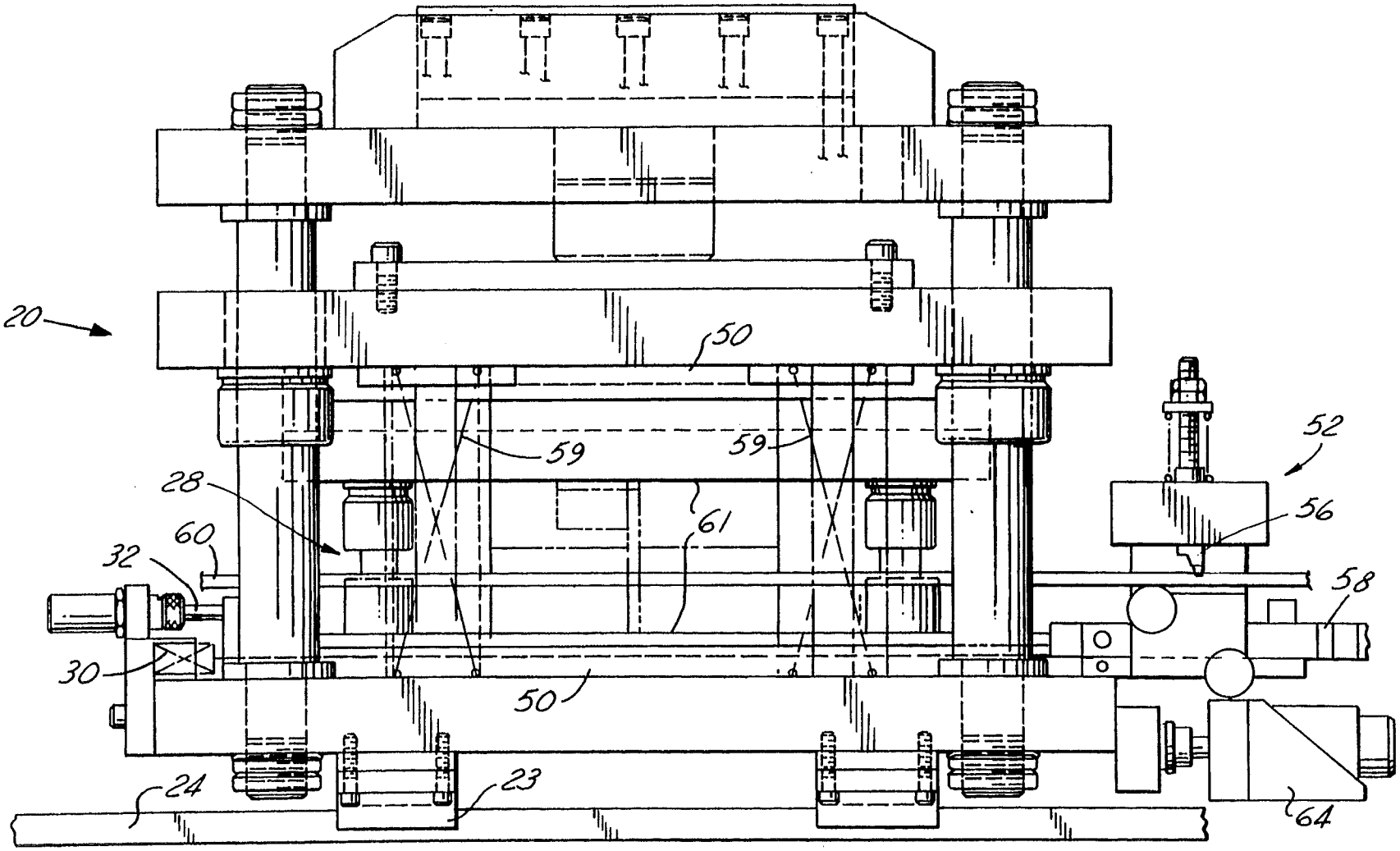
FIG. 3 is a side view of the present invention.

FIG. 3 illustrates press 20, and die 28. Die 28 is mounted on rails 49 received on blocks 50. A spring 30 is mounted between press 20 and die 28. A stubber 32 is also mounted in the vicinity of spring 30. An extension of die 28 receives a pickup assembly 52, as will be described below. As is known, return springs 59 bias the two die surfaces 61 towards relatively-spaced positions. The press is selectively actuated to bring die surfaces 61 towards each other, and perform work on workpiece 60.

The pickup assembly 52 is actuated to engage an aperture in the workpiece sheet 60. The pickup assembly 52 and die 28 are pulled by workpiece 60 along a work path. Die 28 eventually hits stubber 32, and compresses spring 30. Press 20 is only then pulled along the work path by the workpiece 60. Once press 20 is moving, the press is actuated to bring the die surfaces 61 towards each other, and perform work on the workpiece 60.

Figure 4:
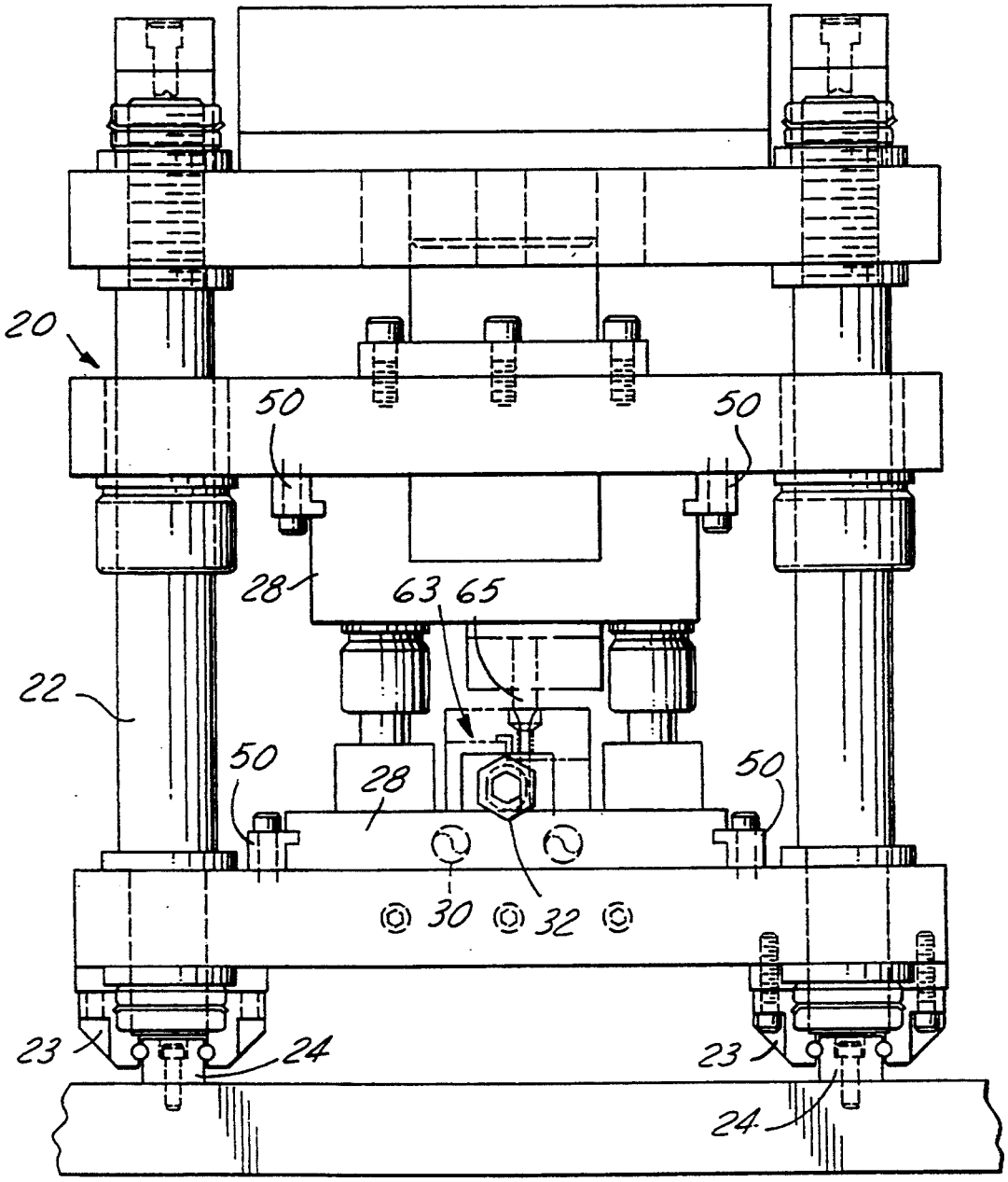
FIG. 4 is an end view of the present invention.

As shown in FIG. 4, guide structure 23 is shown on rails 24. Upper and lower blocks 50 guide die 28 for movement relative to press 20. Further, pickup assembly 52 is illustrated having a cylinder 54 with finger 56 for movement downwardly into an aperture in the moving workpiece 60. Once finger 56 engages an aperture in the moving workpiece, the pickup assembly 52 begins to move with the workpiece 60. Die 28 will also be pulled along with the workpiece. Die 28 soon contacts press 20, which moves along with the workpiece. Once both press 20 and die 28 are moving, the press 20 is actuated to move the die surface 61 towards each other thereby moving the die 28 fixed thereto to perform work on the workpiece. FIG. 4 shows in phantom a material guide 63 and a punch 65 used to perform work on the workpiece 60.

FIG. 5 shows pickup assembly 52 having a cylinder 54 and moving finger 56. As is known, a bar 58, serving as the extension 58 of the die 28, allows the pickup assembly 52 to be adjusted relative to the location of the location of the die 28. Also, guide 57 on pickup assembly 52 is received on a rail 62 to guide the moving pickup assembly 52.

A stubber 64 is mounted on base 26, and provides a force stubbing the return of die 28 and press 20. When the work on the moving workpiece 60 is completed, the pickup assembly 52 is activated to move the finger 56 out of the aperture in the workpiece 60. The workpiece 60 then continues movement without the die and press combination. As shown in FIG. 1, spring 66 is mounted to press 20. Once the pickup assembly 52 is actuated to move the finger 56 out of the aperture, spring 66 returns the press to an originating position. Preferably some stop is disposed at that position such that the originating location of the press is preset. Spring 30 returns die 28 to an original position against a stop on press 20. Thus, after performing the work on the moving workpiece 60, the press 20 and die 28 are returned to an original position through the action of springs 66 and 30. Spring 66 is mounted on a hook 68. FIG. 7 shows two stubbers 64 spaced laterally along the width of the press 20.

Although a preferred embodiment of this invention has been disclosed, it should be understood that a worker of ordinary skill in the art would recognize that certain modifications would come within the scope of this invention. For that reason, the following claims should be studied in order to determine the true scope and content of this invention.

I claim:

1. A machine comprising:

a fixed-base having at least one rail;

a hydraulic press having guides slidably disposed on said rail of said fixed base;

a die slidably mounted on said hydraulic press, said die having means for operably engaging apertures in a moving coil of material for movement therewith;

stop means disposed between said press and said die for providing engagement therebetween to stop relative motion therebetween when said die moves with said coil of material, the coil of material thereby overcoming the inertia of the press and die; and blocks mounted to said press, said blocks being received in said die to guide said die relative to said hydraulic press.

2. A machine comprising:

a fixed-base having at least one rail;

a hydraulic press having guides slidably disposed on said rail of said fixed base;

a die slidably mounted on said hydraulic press, said die having means for operably engaging apertures in a moving coil of material for movement therewith;

stop means disposed between said press and said die for providing engagement therebetween to stop relative motion therebetween when said die moving with said coil of material, the coil material thereby overcoming the inertia of the press and die; and blocks provided on said press, said blocks slidably receiving said die to guide said die relative to said hydraulic press.

3. A machine comprising:

a fixed-base having at least one rail;

a hydraulic press having guides slidably disposed on said rail of said fixed base;

a die slidably mounted on said hydraulic press, said die having means for operably engaging apertures in a moving coil of material for movement therewith;

stop means disposed between said press and said die for providing engagement therebetween to stop relative motion therebetween when said die moves with said coil of material, the coil of material thereby overcoming the inertia of the press and die; and a block provided on said press, said block being received in said die to guide said die relative to said hydraulic press.

* * * * *